US006297436B1

(12) United States Patent
Adams

(10) Patent No.: US 6,297,436 B1
(45) Date of Patent: Oct. 2, 2001

(54) VALVE ASSEMBLY FOR MUSICAL INSTRUMENTS

(76) Inventor: Mark Adams, 10749 Lago Welleby Dr., Sunrise, FL (US) 33351

( * ) Notice: Subject to any disclaimer, the term of this patent is extended or adjusted under 35 U.S.C. 154(b) by 0 days.

(21) Appl. No.: 09/470,921

(22) Filed: Dec. 23, 1999

(51) Int. Cl.[7] ..... G10D 7/10

(52) U.S. Cl. ..... 84/388; 84/387 R; 84/391; 84/389; 84/393; 84/390

(58) Field of Search ..... 84/388, 389, 387 R, 84/391, 393, 390

(56) References Cited

U.S. PATENT DOCUMENTS

| | | | | |
|---|---|---|---|---|
| 408,972 | * | 8/1889 | Heald | 84/388 |
| 4,213,371 | | 7/1980 | Thayer | 84/390 |
| 4,336,738 | * | 6/1982 | Alexander | 84/390 |
| 4,718,318 | | 1/1988 | Boy | 84/390 |
| 4,996,902 | | 3/1991 | Hulot | 84/390 |
| 5,900,563 | * | 5/1999 | Leonard | 84/390 |

* cited by examiner

*Primary Examiner*—Shih-Yung Hsieh
(74) *Attorney, Agent, or Firm*—Malloy & Malloy, P.A.

(57) ABSTRACT

A valve assembly including at least one valve body designed to be mounted on a musical instrument, such as but not limited to a trombone or like "brass" instrument and adapted to regulate air flow through the instrument, between at least a first path of air flow and a second path of air flow each having significantly different lengths, wherein a musician is capable of selectively directing air from the mouth piece or air inlet of the instrument to the air outlet or bell of the instrument along an extended length flow path of the instrument, thereby extending the lower range of the instrument and generating a change in pitch and tonal quality of the musical sound generated. The valve assembly can also include a plurality of valve bodies, each having an elongated, preferably straight line configuration with an open outlet end and an open inlet end as well as an outlet port communicating directly with the inlet end through a first bore and an inlet port communicating directly with the outlet end through a second bore. The shape of the inlet and outlet ports as well as the orientation and configuration of the first and second bores are such as to define a smooth, substantially unrestricted flow of air through the instrument regardless of the selected flow path through which the air is directed.

13 Claims, 4 Drawing Sheets

VALVE ASSEMBLY FOR MUSICAL INSTRUMENTS

BACKGROUND OF THE INVENTION

1. Field of the Invention

This invention is directed to a valve assembly designed for use in musical instruments, such as trombones and other members of the "brass" or "wind" family. The valve assembly of the present invention is structured to permit the selective directing of air flow along predetermined ones of a plurality of flow paths in order to selectively vary the length of the path the air travels from the air inlet or mouth piece to the air outlet or bell of the instrument, and therefore, extend the lower range of the instrument and allow for a selective change in the pitch and tonal quality offered by the musical instrument.

2. Description of the Related Art

Air flow valves having a variety of different configurations, structures and other operative features have been used on musical instruments in the brass and/or wind family for over a hundred years in order to provide the musician playing the instrument with a greater range in terms of both pitch and tonal quality. Generally speaking, such flow path selector valves, particularly of the type used with brass-wind instruments, are either of the rotary type or alternatively, are of the piston and cylinder type. In the latter category, also commonly referred to as Perinet valves, a piston is longitudinally slidable within a cylinder against a biasing force. The piston normally has both a longitudinal bore and transverse bore which enable air to be conducted along a shorter or longer path of travel, in order to selectively vary the tonal quality of the instrument. Passages formed in this type of valve are round in cross section, and thereby, permit free flow of air therethrough which is desirable for achieving increased sound volume and a high quality tones. However, one recognized disadvantage for this type of valve is a relative long actuating stroke and the existence of high inertia in operating such valves. This limits the actuation time of the valve, and therefore, the speed at which the instrument can be played.

The other category of air flow valves, as set forth above, relates to rotary valves, which typically include a valve disk which is provided at its periphery with air inlets and air outlets. These air inlets and outlets are generally disposed to communicate with one another through radial passages. Conventional rotary valves, generally of the type described, are for the most part highly regarded for use in musical instruments due to their quick action and relative simplicity of structure, as compared to the piston type valve. However, one distinct disadvantage associated with known, conventionally structured rotary valves is the unwanted addition of overtones to the sound of the instrument. Such overtones are considered to be the result of air passing over sharp bends existing along a flow path of the air as it travels through the instrument. These shape bends restrict the passage of air through the instrument and prevent a more desirable free and unrestricted air flow, which produces a pure and uniform tonal quality. In conventional rotary valve construction and design, the aforementioned sharp bends occur either inside the valve body or at the junction of the openings formed in the valve body and disposed between the valve body and the main tubing of the instrument itself. Further, when sound waves travel through an instrument and are directed along sharp turns or bends in the tubing of the instrument, a certain portion of the waves reflect off the inside surfaces of the air passage. Such partial reflection reduces the energy of the fundamental wave form and produces the aforementioned undesirable overtones.

Accordingly, there is a need in the musical industry for an improved flow regulating valve assembly for use on a musical instrument such as, but not limited to, a brass type of wind instrument. If any such improved valve assembly were developed, it should be capable of selectively varying the length of the path of air flow from the air inlet or mouth piece of the instrument to the air outlet or bell of the instrument, in order to provide the musician with a greater range of sound through a selective varying of the pitch of the instrument. In addition, if any such improved air flow valve assembly were developed, it should be configured, dimensioned and otherwise structured to provide a smooth, unrestricted air flow along any one of a plurality of air flow paths selected by the musician, thereby providing a desired tonal quality and allowing the musician to exert less effort when playing the lower notes. Further, any such improved air flow valve assembly developed should be adjustably mounted onto the musical instrument so as to facilitate removal of the assembly from the instrument for cleaning. Finally, any such improved air flow valve assembly would ideally also comprise either a single valve body or alternatively, a plurality of valve bodies, and could also be adapted for use in a variety of musical instruments such as, but not limited to slide trombones, baritone horns, euphoniums, tubas, french horns and trumpets as well as modern marching bugles.

SUMMARY OF THE INVENTION

The present invention addresses these and other needs in the art and is directed to a valve assembly designed to regulate the flow of air passing through a musical instrument, such as but not limited to "brass" and/or "wind" types of musical instruments, by selectively permitting air to flow through an extended path of travel through the instrument during the playing of the instrument. The extended path of air flow will expand the lower range of the instrument, while providing a smoother and substantially unrestricted path of travel and the generation of a pure, uniform tone quality while, at the same time requiring the musician to exert less effort when playing the lower notes.

The structural and operative features of the valve assembly according to the present invention is primarily described herein with reference to a slide trombone, particularly of the type which includes a trombone "F" attachment, "F/E flat" attachment or "F/G flat" attachment. However, it is emphasized that the valve assembly of the present invention can be adapted for use on a variety of other instruments including but not limited to, baritone horns, french horns, tubas, euphoniums, modern marching bugles and at least to some extent, trumpets. As will be emphasized hereinafter, the valve assembly of the present invention, and more specifically, the one or more valve bodies associated therewith, are not restricted to any specific pitch change. To the contrary, the pitch change can vary anywhere from one-half step down to two and one-half steps down, and possibly more, dependent at least in part on the number of valve bodies mounted on an instrument.

The valve assembly of the present invention comprises at least one valve body having a somewhat elongated and substantially linear or straight line configuration. In addition, the valve body includes oppositely disposed open ends defining an inlet end and an outlet end. The valve body also includes an outlet port and an inlet port which are preferably integrally formed in a sidewall or exterior surface of the valve body. Each of the outlet port and inlet port extends into the interior of the valve body in direct communication with the inlet end and the outlet end, respectively. More specifically, a first bore is formed on the interior of the valve body and extends from the inlet end to the outlet port. A second bore is also formed on the interior of the valve body and extends from the inlet port to the outlet end. The valve body also includes a mid-portion formed thereon, substantially between the outlet port and the inlet port. Further, the mid-portion is structured and disposed out of fluid communication with either of the first or second bores. In the preferred embodiment, the first and second bores are only disposed in fluid communication with one another by their selective positioning and partial defining of a first flow path and a second flow path, as more specifically described hereinafter.

The valve body is mounted on the instrument so as to be selectively rotatable about its own longitudinal access, and is thereby, selectively positionable so as to at least partially define either the first flow path or the second flow path, as set forth above. Each of the first and second flow paths are additionally defined by tubing, which forms part of the musical instrument including, but not limited to, the "F", "F/E flat" or "F/G flat" attachments, as also will be explained hereinafter. Some form of these attachments are well known for use in combination with slide trombones, albeit not in the form of the present invention which provides for a much smoother and/or straighter air flow, as they are designed to significantly extend the length of the primary tubing of the instrument, and accordingly, the length of the path of air flow which passes through the trombone from the mouth piece or air inlet to the bell or air outlet of the instrument. The extension of the path of air flow, as set forth above, allows the musician to selectively play the instrument in the lower scale ranges. In addition, and due at least in part to the valve assembly being selectively rotatable and, therefore, positionable between either the first air flow path or the second air flow path, the musician, while playing an instrument which incorporates the valve assembly of the present invention, may easily change pitch from one-half step down to two and one-half steps down. This ability may be at least partially dependent on the number of valve bodies utilized in a given instrument incorporating the valve assembly of the present invention.

When the valve body of the present invention is positioned so as to at least partially define a first flow path, air, traveling through the instrument is directed through a very short section of tubing of the musical instrument located exteriorly of valve body. Further, the short section of tubing preferably has its opposite ends in direct alignment or registry with both the outlet and inlet ports of the valve body when disposed in the aforesaid position. When the valve body is selectively positioned, as by rotating the valve body, to at least partially define a second flow path, the outlet port and the inlet port are respectively aligned with an inlet and an outlet of the "F" attachment. Accordingly, the second flow path is much longer than the first flow path resulting in the pitch of the generated tone being lower by generally about two and one-half steps, from the key of "B flat" to the key of "F". One or more additional valve bodies can also be mounted within the same instrument in "series" or spaced relation to one another, such as by providing a second valve body in the length of tubing defining the "F" attachment to the trombone. This has the effect of adding even more length to the path of air flow in the instrument, and further, lowers the instruments pitch to an "E flat" or "D," or possibly even lower.

The present invention further comprises in the preferred embodiments a positioning assembly. More specifically, the selective rotation of the valve body of the present invention can be manually accomplished by the musician's manipulation of a positioning assembly which, at least in part, is mounted in an exteriorly accessible location, adjacent the position on the instrument normally occupied by the hand used to support the instrument when playing. Proper movement of the supporting hand, and particularly, the thumb will preferably serve to rotate the valve body from the aforementioned first flow path, against a biasing spring associated with the positioning assembly, into the second flow path. As set forth above, the second flow path significantly extends the length of the path of air flow through the musical instrument, thereby enabling the musician to play the lower notes.

Additional structural and operative features of the valve assembly of the present invention include the provision of a smooth, substantially unrestricted air flow through the one or more valve bodies used with the instrument, which results in the production of musical notes having a pure and uniform tone quality due to the elimination of sharp bends, turns or other restrictions along either the first or second flow path defined, at least in part, by the selective positioning of the valve body. Such structural and operative features further include a somewhat elongated configuration of the outlet port and the inlet port, and a smooth, shallow angled orientation or configuration of each of the first and second bores as they respectively extend from the inlet and outlet ends of the valve body to the outlet and inlet ports, located in the sidewall of the valve body. By virtue of this shallow angle of orientation of each of the bores, the desired unrestricted flow of air through the valve body and into the instrument is accomplished.

Accordingly, a general object of the present invention is to provide a valve assembly for a musical instrument, such as a trombone or other instrument in the "wind" family, which minimizes if not eliminates sharp bends, turns or other restrictions along either the first flow path and/or the second flow path which is usually defined, at least in part, by an "F" attachment or the like, and which thereby, permits the production of musical notes having a pure sound and uniform tonal quality.

Another general object of the present invention is to provide a valve assembly which is structured to be removably mounted to a musical instrument, such as a trombone or other instrument, to facilitate both the cleaning and repairing of the valve assembly and/or instrument.

Yet another general object of the present invention is to provide a valve assembly attached to a trombone or other instrument which is easily disassembled to facilitate cleaning, lubricating and repairing of the valve assembly and/or instrument itself.

The general objects of the present invention set forth above are intended to be illustrative only and should not be construed as limiting in any way. In fact, these and other objects, features and advantages associated with the present invention are likely to become more evident from the drawings and the detailed description of the invention in the preferred embodiment, which follow.

BRIEF DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

Figure 3:
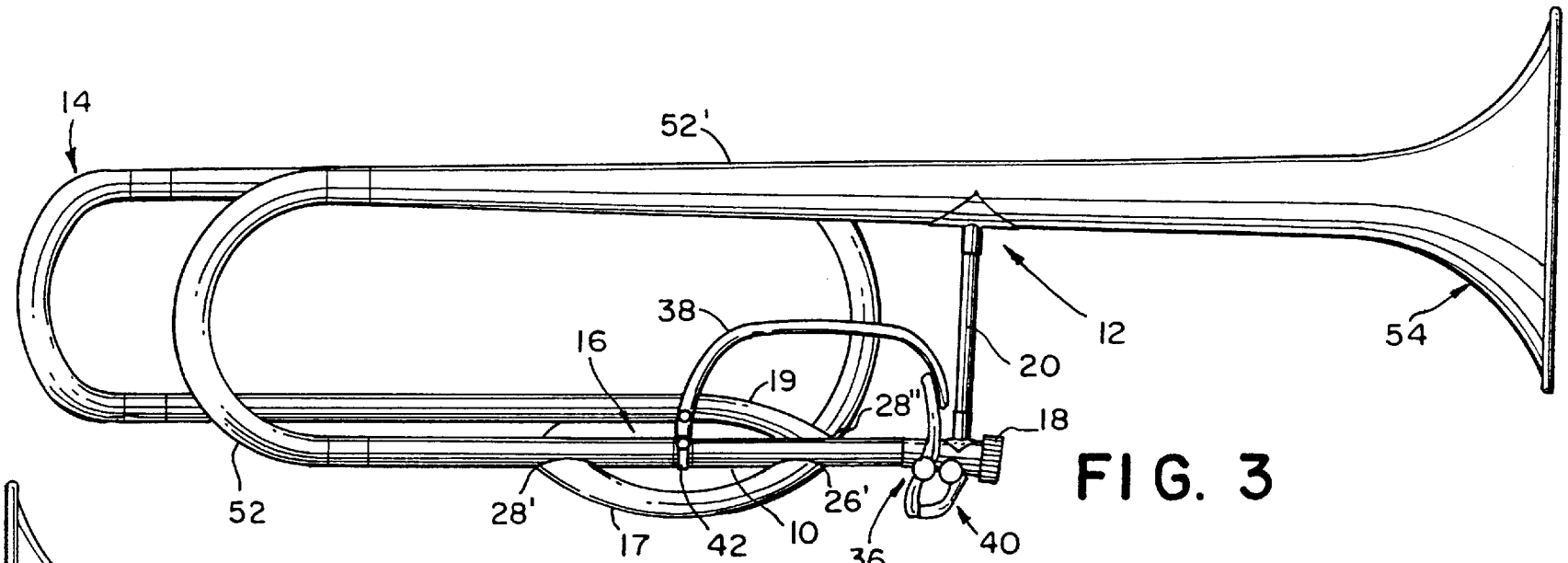
FIG. 3 is a side view of a brass or wind type of musical instrument in the form of a trombone incorporating the valve assembly of the present invention.
Figure 4:
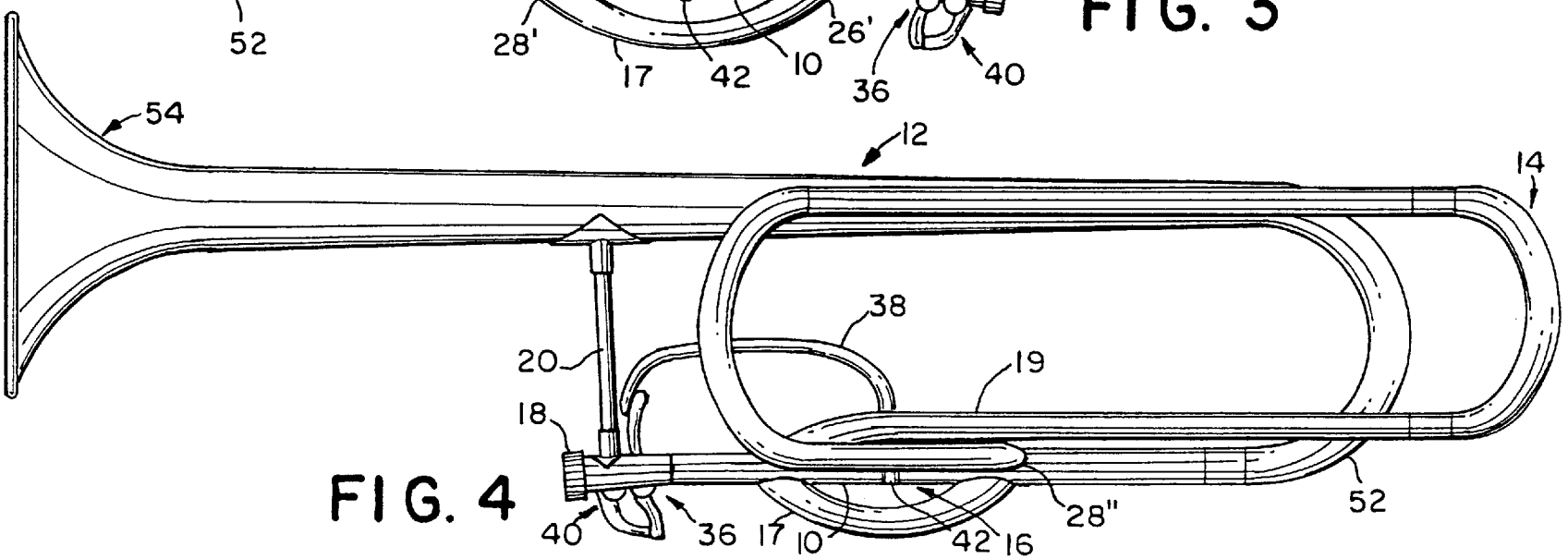
FIG. 4 is an opposite side view from that of FIG. 3.
Figure 9:
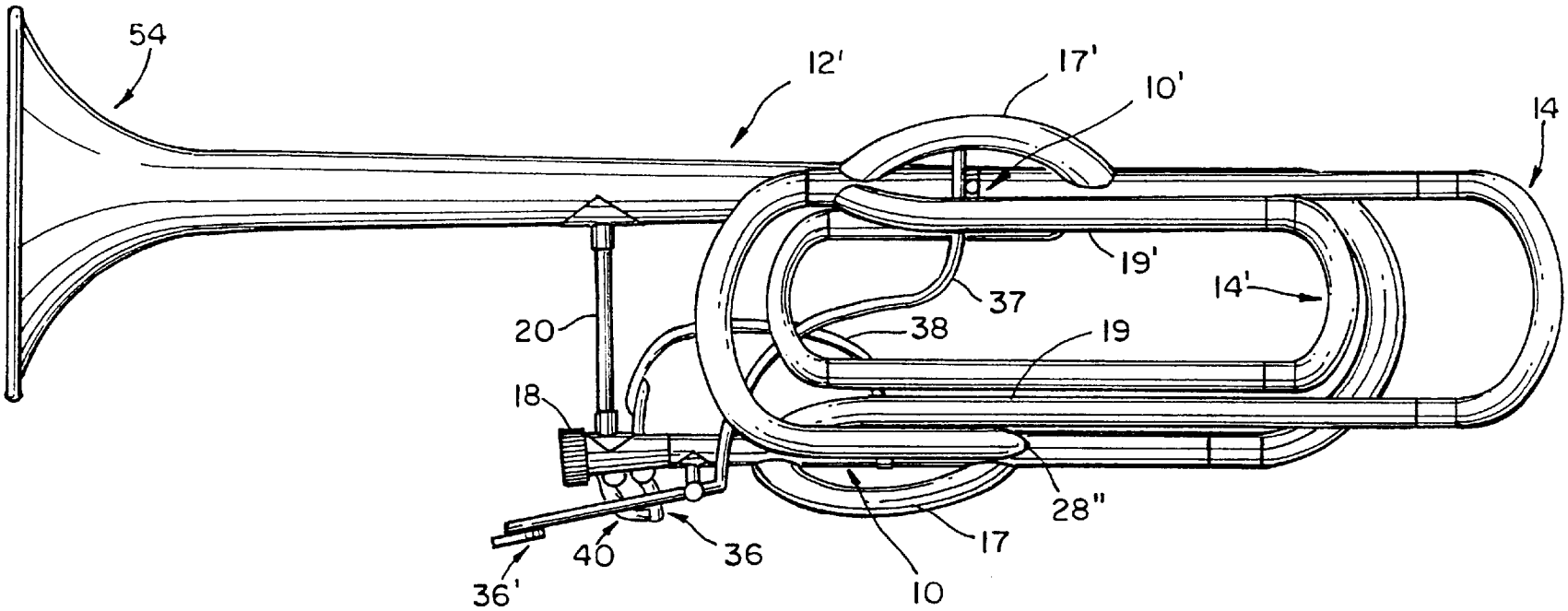
FIG. 9 is a side view of a brass or wind type of musical instrument in the form of a trombone incorporating the valve assembly of the present invention comprising two separate valve bodies. Like reference numerals refer to like parts throughout the several views of the drawings.

As shown in the accompanying drawings, the present invention relates to a valve assembly for musical instruments such as, but not limited to a trombone or other instruments in the wind or brass family. As shown in FIGS. 3 and 4, the valve assembly includes at least one valve body, generally indicated as 10, designed to be used in combination with a slide trombone, generally represented as 12. The trombone 12 may be of the type which includes an "F" attachment generally indicated as 14, and/or may also incorporate and "F/E flat" attachment 141 as shown in FIG. 9. In addition, and as noted briefly above, the valve assembly of the present invention can be used in combination with a variety of other "brass" or "wind" instruments such as, but not limited to baritone horns, euphoniums, tubas, french horns, modern marching bugles and, in some instances, trumpets. With reference to FIGS. 3 and 4, however, which depict a slide trombone, the valve body 10 of the present invention is designed to be rotatably, and preferably, slidably mounted within a section of the tubing 16 of the trombone 12 or other instrument, downstream of the coupling structure 18 and the brace 20. It will be appreciated by those of skill in the art that the coupling structure 18 can be used to removably secure the trombone slide to the remainder of the trombone instrument 12, as shown in FIGS. 3 and 4.

Figure 1:
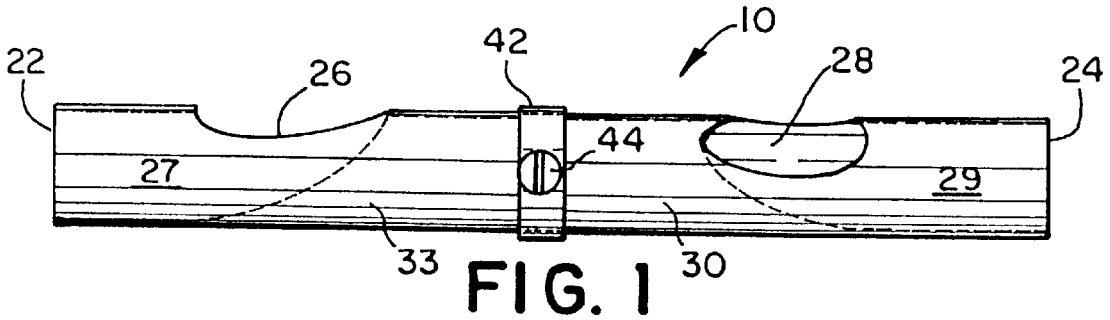
FIG. 1 is a side view in partial phantom of a valve body incorporated in a valve assembly in accordance with a preferred embodiment of the present invention.
Figure 2:
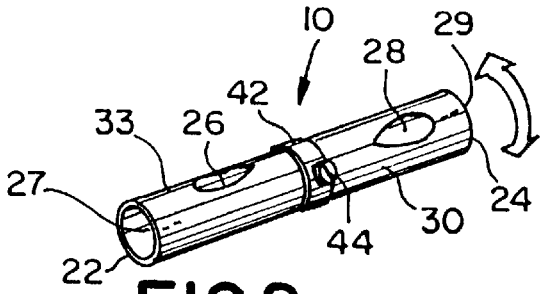
FIG. 2 is a perspective view of the valve assembly illustrated in FIG. 1.

Referring now to FIGS. 1 and 2, in the preferred embodiment the valve body 10 includes an elongated, substantially linear or straight line configuration terminating in oppositely disposed open ends 22 and 24 disposed in somewhat opposing relation to one another, and respectively, defining the inlet end 22 and the outlet end 24. In addition, the valve body 10 includes an outlet port 26 and an inlet port 28 disposed in longitudinally spaced apart relation along the length of the valve body 10. The outlet port 26 is disposed in direct fluid communication with the inlet end 22 by means of a first interior bore 27. Similarly, the inlet port 28 is disposed in direct fluid communication with the outlet end 24 by means of an second interior bore 29. As can be noted from FIG. 1, the outlet port 26 and the inlet port 28 are preferably both integrally formed in the sidewall and/or exterior surface 30 and further, are also preferably disposed in axially off-set relation to one another. This axial off-set relation or non-alignment of the outlet port 26 and the inlet port 28 is structurally adapted to align with certain specific tubing of the instrument 12 and in particular, the tubing section 16, referred to above. The ports inside the valve body 10 are also preferably slightly conical in shape, as illustrated and the first and second interior bores 27 and 29 are preferably separated by generally about three inches. Also, the valve body 10 is preferably made of brass although other materials such as nickel, copper, model or a combination of these metals and possibly other non-metallic materials could be utilized as well. The body of the instrument can be held together by soft solder but silver solder (brazing) is more desirable.

The valve assembly of the present invention further includes a positioning assembly, generally indicated as 36 in FIGS. 3 and 4. The positioning assembly 36 preferably includes a handle or lever 38 and a pivotal type of connector and/or coupling 40 mounted at an exteriorly accessible location on the instrument 12 that is structured to rotate the valve body 10 between a first flow path and a second flow path. The positioning assembly 36 is located in the general vicinity of the instrument where a supporting hand of the musician will engage and support the instrument 12 while playing. This area is also in the general vicinity of the tubing section 16 and the brace 20. The positioning assembly 36 further preferably includes a biasing spring or like biasing member structured to normally tending to bias the valve body 10 into a position which at least partially defines the first flow path. However, proper manipulation by the supporting hand of the musician will rotate the valve body 10 against the biasing force and into a position which at least partially defines a second flow path. To accomplish such selective rotation or positioning of valve body 10, the positioning assembly 36 further includes a bearing ring 42, which preferably has a generally annular configuration and which further, preferably includes a locking screw or like connector element 44, shown in FIGS. 1 and 2 to prevent the valve body 10 from sliding back and forth during rotation. The bearing ring 42 preferably surrounds a mid-portion 33 of the valve body 10 and is removably, but fixedly secured to the exterior of the mid-portion 33 by means of a tightening of the locking connector 44. The bearing ring 42 is preferably also connected to one end or other appropriate part of the lever or handle 38 such that manipulation of the lever or handle 38 will cause a rotation of the valve body 10 through the interconnection between the lever 38 and the bearing ring 42. Release of the lever or handle 38 will allow the valve body 10 to rotate back into the position which at least partially defines the first flow path. The first and second flow paths will be more specifically defined hereinafter, along with the difference in operating characteristics and performance of the instrument as air travels along either the first or the second flow path, dependent upon the selective positioning of the valve body 10 by the player.

Figure 5:
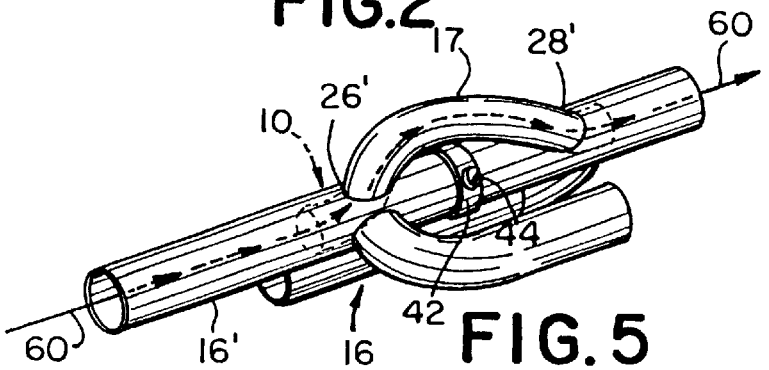
FIG. 5 is a perspective view in partial cut away and phantom of a portion of a musical instrument of the type shown in FIGS. 3 and 4, with the valve body of FIGS. 1 and 2 incorporated therein.
Figure 6:
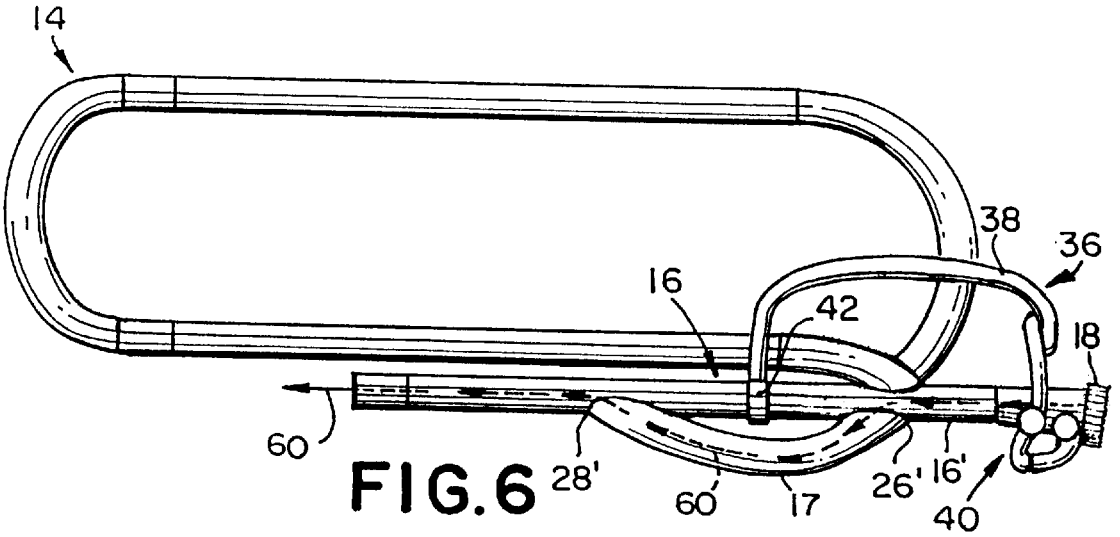
FIG. 6 is a side view in partial cutaway showing a structural detail of the embodiment of FIG. 5.

In operation, with initial reference to FIGS. 2, 5, and 6, the valve body 10 is preferably disposed normally or at rest in a position which at least partially defines the first flow path. As set forth above, the normal positioning of valve body 10 into the position shown in FIGS. 5 and 6 is due to the biasing force exerted thereon by the positioning assembly 36. When the valve body 10 is so positioned, the direction of air flow is represented in FIGS. 5 and 6 as 60, wherein air entering from a mouth piece (not shown) or air inlet of the instrument 12 passes into the tubing section 16 at the leading end thereof 16' downstream of the slide coupling 18. The valve body 10 is oriented such that the air flow 60 enters the tubing section 16 and passes thorough the open inlet end 22 and along the length of the first interior bore 27. The air flow exits the outlet port 26 which is aligned with the inlet 26' of the relatively short tubing section 17 which also at least partially defines the aforementioned first flow path. The flow of air continues along tubing section 17 until exiting tube section 17 as at 28'. The opening 28' in tubing section 17 is disposed and aligned directly with the inlet port 28 disposed in direct fluid communication with the second interior bore 29 and the outlet end 24 of the valve body 10. The flow of air continues along what may be also defined as the first flow path by continuing along tubing section 52 (shown in FIG. 3) and eventually exits the instrument 12 through the bell or air outlet 54.

Figure 7:
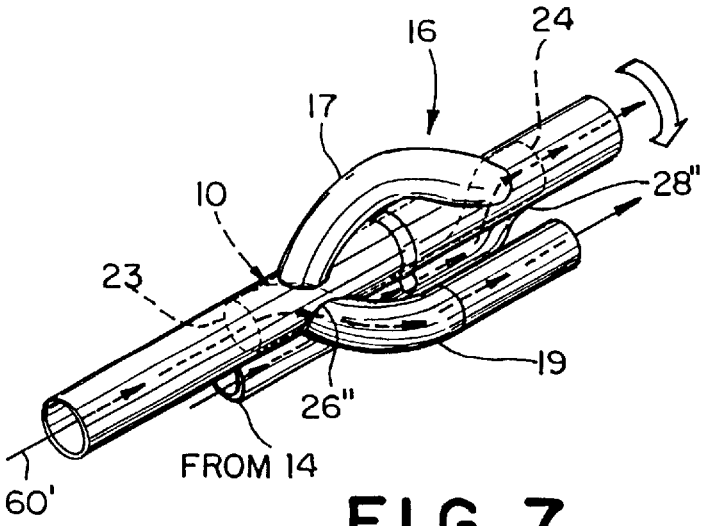
FIG. 7 is a perspective view similar to that of FIG. 5 with the valve assembly of the present invention shown in a different position.
Figure 8:
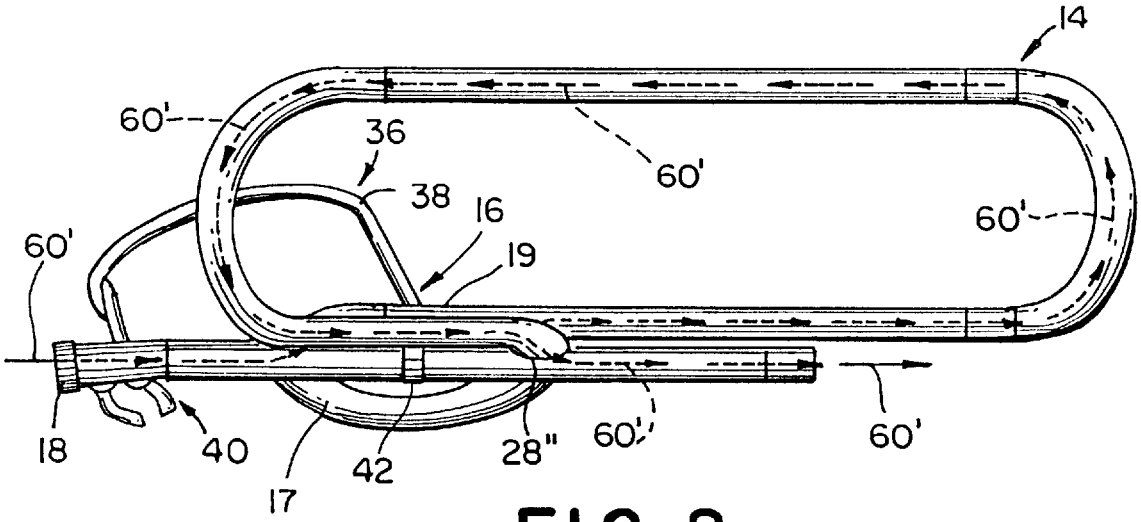
FIG. 8 is an opposite side view from that of FIG. 6.

However, when the player of the instrument 12 desires to play notes in a lower scale range, and thereby, change the pitch of the sound generated, the positioning assembly 36 is manually engaged by the supporting hand of the player to the extent of rotating the valve body 10 into a position which at least partially defines a second flow path. With specific reference to FIGS. 7 and 8, the second flow path is defined by the flow of air indicated by directional arrow 60' by-passing or being diverted from the short tubular section 17. More specifically, the air flow 60' enters the inlet end 22 of the valve body 10 and passes along the interior first bore 27 and outwardly therefrom to the outlet port 26, as can be noted in FIG. 1. The tubing section 19, shown in FIGS. 7 and 8, and which also defines a portion of the second flow path has an inlet as at 26' aligned with the outlet port 26. The tubing section 19 is preferably defined as part of an "F" attachment 14, shown in FIGS. 3, 4 and 8, which is configured into an almost continuous loop including an outlet 28" disposed in aligned relation with the inlet port 28 of the valve body 10. The air flow, after passing along the significantly longer second flow path of the "F" attachment 14 re-enters the valve body 10 through the inlet port 28, travels along the second interior bore 29 and exits from the outlet end 24 of the valve body 10. Release of the positioning assembly 36 will cause the valve body 10 to rotate back into a position which at least partially defines the first flow path, described above in detail.

Other structural and operative features of the invention included in the valve body comprise a substantially elongated configuration of both of the outlet port 26 and inlet port 28, as well as the shallow angled configuration and/or orientation of the first interior bore 27 and the second interior bore 29, as they define fluid communication and extend between the respective open ends 22 and 24, to the respective outlet port 26 and inlet port 28. The dimensioning, configuration and disposition of the ports 26 and 28 as well as the interior bores 27 and 29 eliminates any sharp bends, shape turns or other flow restrictions within the valve body. Accordingly, a smooth, substantially unrestricted flow of air is allowed to pass from the mouth piece or air inlet of instrument 12 to the air outlet or bell 54, and also, through the valve body 10, when the valve body 10 is either in the first flow path or the second flow path.

Yet another embodiment of the present invention as shown in FIG. 9 comprises a trombone 12' including the valve assembly of the present invention having both a first valve body 10 and a second valve body 10', wherein the trombone 12' has both an "F" attachment 14 an "F/E flat" attachment 14'. The operative features of the second valve body 10' are substantially the same as the valve body 10. Also a positioning assembly 36' having an extended, interconnecting link 37 is positioned so as to be easily operated by the musician. The valve body 10' is operatively interconnected to direct air flow through the short tubing 17' and the elongated tubing 19' and accordingly operates in a similar fashion to the first valve body 10 as described above.

The present invention also offers other advantages in terms of facilitating both cleaning and repairing the valve assembly and/or the musical instrument onto which it is incorporated. More specifically, the locking screw or like connector element 44 shown in FIGS. 1 and 2 can be loosened or unscrewed so as to permit the valve body 10 to be slidably moved out of the tube section 16 and end 18 of the instrument 12. This may also facilitate storage of the instrument 12 and valve assembly, but is certainly desirable in that it readily permits the valve body 10 to be cleaned, or repaired if that should ever be needed, as can be the tube section 16 and other parts of the instrument 12. The valve body 10 can also be easily replaced or mounted onto the instrument 12 for playing thereof.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A valve assembly designed to regulate air flow through a musical instrument, said valve assembly comprising:

a) at least one valve body rotatably mounted between an air inlet and an air outlet of the instrument, b) said valve body including an open inlet end and an open outlet end, c) an outlet port disposed in direct fluid communication with said inlet end and an inlet port disposed in direct fluid communication with said outlet end, d) said outlet port and said inlet port being formed in a sidewall of said valve body in longitudinally spaced relation to one another along a length of said valve body and being further disposed in axially off-set relation to one another, e) a first bore and a second bore formed within said valve body, said first bore extending from said inlet end to said outlet port and said second bore extending from said inlet port to said outlet end wherein said first bore and said second bore each comprise a substantially shallow angled configuration along respective lengths thereof, f) said valve body selectively positionable to define a first flow path and a second flow path between said air inlet and said air outlet of the instrument, and g) said first flow path being significantly shorter than said second flow path.

2. A valve assembly designed to regulate air flow through a musical instrument, said valve assembly comprising:

a) at least one valve body rotatably mounted between an air inlet and an air outlet of the instrument, b) said valve body including an open inlet end and an open outlet end, c) an outlet port disposed in direct fluid communication with said inlet end and an inlet port disposed in direct fluid communication with said outlet end, d) a first bore and a second bore formed within said valve body, said first bore extending from said inlet end to said outlet port and said second bore extending from said inlet port to said outlet end, wherein said first bore and said second bore are each disposed in a substantially shallow angled orientation along respective lengths thereof, e) said valve body selectively positionable to define a first flow path and a second flow path between said air inlet and said air outlet of the instrument, and f) said first flow path being significantly shorter than said second flow path.

3. A valve assembly as recited in claim 2 wherein said valve body further comprises a mid-portion disposed between said outlet port and said inlet port and out of fluid communicating relation with said first bore and said second bore.

4. A valve assembly designed to regulate air flow through a musical instrument, said valve assembly comprising:

a) at least one valve body axially slidable and rotatably and removably mounted on the instrument between an air inlet and an air outlet, b) said valve body including an open inlet end and an open outlet end, c) an outlet port disposed in direct fluid communication with said inlet end and an inlet port disposed in direct fluid communication with said outlet end, d) said valve body selectively positionable to define a first flow path and a second flow path between said air inlet and said air outlet of the instrument, e) said first flow path being significantly shorter than said second flow path, and f) said valve body further comprising an elongated, substantially straight line configuration between said inlet end and said outlet end and axially rotatable between said first flow path and said second flow path.

5. A valve assembly as recited in claim 4 wherein said valve body further comprises a mid-portion disposed between said outlet port and said inlet port and out of fluid communicating relation with the first and second bores.

6. A valve assembly as recited in claim 5 further comprising a positioning assembly mounted in an exteriorly accessible location on the instrument and connected to said mid-portion to rotatably position said valve body between said first and second flow path.

7. A valve assembly as recited in claim 6 wherein said positioning assembly comprises a bearing ring removably connected in gripping engagement with said valve body and interconnecting a remainder of said positioning assembly to said valve body.

8. A valve assembly as recited in claim 7 wherein said bearing ring comprises a substantially annular configuration fixedly and removably attachable to said mid-portion and disposed and structured to selectively rotate said valve body on the instrument.

9. A valve assembly as recited in claim 8 wherein, said bearing ring is disposed and configured to prevent axial sliding of said valve body relative to the instrument.

10. A valve assembly designed to regulate air flow through a musical instrument, said valve assembly comprising:

a) at least one valve body axially rotatable on the instrument and including an elongated, substantially linear configuration, b) said valve body comprising an open inlet end and an open outlet end each formed on an oppositely disposed extremity thereof, c) an outlet port and an inlet port formed in longitudinally spaced relation to one another along the length of said valve body, d) a first bore and a second bore formed within said valve body, said first bore extending from said inlet end to said outlet port and said second bore extending from said inlet port to said outlet end, e) said valve body selectively positionable to define a first flow path and a second flow path between an air inlet and an air outlet of the instrument; said first flow path being of significantly shorter length than said second flow path, f) a positioning assembly mounted in an exteriorly accessible location on the instrument and connected to rotate said valve body between said first flow path and said second flow path, and g) said inlet port and said outlet port each comprise a substantially elongated shape dimensioned and configured to facilitate a smooth, unrestricted air flow along both said first and second flow paths.

11. A valve assembly as recited in claim 10 wherein said first bore and said second bore are each disposed in a substantially shallow angled orientation along the lengths thereof.

12. A valve assembly designed to regulate air flow through a musical instrument, said valve assembly comprising:

a) a plurality of valve bodies mounted in spaced relation to one another between an air inlet and an air outlet of the instrument, b) one of said plurality of valve bodies selectively positionable to define a first flow path and a second flow path between said air inlet and said air outlet of the instrument, c) at least one other of said plurality of valve bodies mounted along said second flow path and selectively positionable between and at least partially defining said second flow path and a third flow path, each of said valve bodies axially rotatable on the instrument and including an elongated, substantially linear configuration, d) each of said valve bodies further comprising an open inlet end and an open outlet end each formed on an oppositely disposed extremity thereof, e) each of said valve bodies further comprising an outlet port and an inlet port formed in longitudinally spaced relation to one another, f) each of said valve bodies further comprising a first bore and a second bore formed on the interior thereof, said first bore extending from said inlet end to said outlet port and said second bore extending from said inlet port to said outlet end, g) said first flow path being of significantly shorter length than said second flow path, h) each of said valve bodies further comprising a positioning assembly mounted in an exteriorly accessible location on the instrument and connected to rotate said valve body between a plurality of different flow paths, and i) said outlet port and said inlet port each comprising a substantially elongated shape dimensioned and configured to facilitate a smooth, substantially unrestricted air flow through the instrument and along said plurality of paths of travel.

13. A valve assembly as recited in claim 12 wherein said first bore and said second bore of each of said plurality of valve bodies are disposed in a substantially shallow angled orientation along the respective length thereof.

* * * * *